US007962060B2

(12) United States Patent
Moon

(10) Patent No.: US 7,962,060 B2
(45) Date of Patent: Jun. 14, 2011

(54) CLEANING AND SEALING APPARATUS OF AN IMAGE FORMING APPARATUS AND DEVELOPING UNIT THEREOF

(75) Inventor: Ji Won Moon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 416 days.

(21) Appl. No.: 11/944,492

(22) Filed: Nov. 23, 2007

(65) Prior Publication Data

US 2008/0187353 A1 Aug. 7, 2008

(30) Foreign Application Priority Data

Feb. 6, 2007 (KR) ..... 10-2007-0012150

(51) Int. Cl.
*G03G 15/08* (2006.01)

(52) U.S. Cl. ..... 399/102; 399/103; 399/350

(58) Field of Classification Search ..... 399/102, 399/103, 105, 111, 119, 249, 350
See application file for complete search history.

(56) References Cited

U.S. PATENT DOCUMENTS 6,178,301 B1 * 1/2001 Kojima et al. ..... 399/98
2007/0253727 A1 * 11/2007 Hashizume et al. ..... 399/103

FOREIGN PATENT DOCUMENTS

JP 2004144803 A * 5/2004
KR 2004-69737 8/2004

* cited by examiner

*Primary Examiner* — David M Gray
*Assistant Examiner* — Barnabas T Fekete
(74) *Attorney, Agent, or Firm* — Stanzione & Kim, LLP

(57) ABSTRACT

An image forming apparatus capable of cleaning contact members by using developer leakage preventing components includes a photosensitive member, a developer feeding member which feeds a developer to supply the developer to the photosensitive member, contact members which keep a development gap or a development nip constant between the photosensitive member and the developer feeding member, and a sealing member which contacts the developer feeding member to prevent the developer from leaking. The sealing member may include cleaning portions which contact the contact members to clean a surface of the contact members. The sealing member may further include a sealing portion for preventing leakage of the developer, and cut portions which section the sealing portion from the cleaning portions. The cleaning portions may extend in a direction different from the sealing portion and contact the contact members.

20 Claims, 7 Drawing Sheets

CLEANING AND SEALING APPARATUS OF AN IMAGE FORMING APPARATUS AND DEVELOPING UNIT THEREOF

CROSS-REFERENCE TO RELATED APPLICATIONS

This application claims the benefit of Korean Patent Application No. 2007-0012150, filed on Feb. 6, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus and a developing unit thereof that is equipped with sealing members to prevent a developer from leaking.

2. Description of the Related Art

Generally, an image forming apparatus is an apparatus that prints an image on a printing medium, e.g., paper, according to an inputted image signal. As one example of the image forming apparatus, an electrophotographic image forming apparatus is configured such that a light beam is scanned to a photosensitive member charged with an electric potential to form an electrostatic latent image on the outer peripheral surface of the photosensitive member, the electrostatic latent image is developed into a visible image by adhering a developer onto the electrostatic latent image, and the visible image is transferred and fixed onto paper.

A developing unit of an image forming apparatus supplies a developer stored therein to a photosensitive member to develop an electrostatic latent image of the photosensitive member. FIG. 1 is a sectional view illustrating components of a conventional developing unit, and FIG. 2 is a view seen in the F direction of FIG. 1. As illustrated in FIGS. 1 and 2, the conventional developing unit includes a developer feeding member 2 which supplies a developer to a photosensitive member 1, contact members 3 which are rotatably mounted to both ends of a rotating shaft 2*a* of the developer feeding member 2 and rotate while contacting the outer peripheral surface of the photosensitive member 1, and a sealing device 4 which prevents the developer inside the developing unit from leaking outside.

The contact member 3 has an outer diameter larger than the developer feeding member 2. Accordingly, a development gap G is defined between the developer feeding member 2 and the photosensitive member 1. In the process of adhering the developer to the electrostatic latent image of the photosensitive member 1 to develop the electrostatic image to the visible image, it is important to maintain a constant development gap G to secure uniform and stable image quality.

The sealing device 4 includes first sealing members 5 which are provided on both ends of the developer feeding member 2 to prevent the developer from leaking through side portions of the developer feeding member 2, and a second sealing member 6 which is provided to contact a bottom of the developer feeding member 2 to prevent the developer from leaking through a lower portion of the developer feeding member 2. The second sealing member 6 is formed as a film type. One end portion of the second sealing member 6 contacts a housing 7 of the developing unit, and the other end portion of the second sealing member 6 contacts the outer peripheral surface of the developer feeding member 2 due to its own elasticity.

However, in the above conventional developing unit, because the second sealing member 6 has a length similar to the developer feeding member 2 in the axial direction, both ends of the second sealing member 6 interfere with the first sealing members 5 which seal the side portions of the developer feeding member 2. Because the adhesive force at both ends of the second sealing member 6 adhering to the housing 7 is weakest, the interference between both ends of the second sealing member 6 and the first sealing members 5 may cause f the second sealing member 6 to separate from the housing 7 when the developer feeding member 2 rotates.

Further, the sealing device 4 of the conventional developing unit cannot perfectly prevent leakage of the developer. If the developer leaks, the scattered developer contaminates the contact member 3 and forms a foreign substance layer between the contact member 3 and the photosensitive member 1. If the contact member 3 is contaminated, the development gap G between the developer feeding member 2 and the photosensitive member 1 is not kept constant, and it causes image quality degradation.

To solve this problem, Korean Patent Registration No. 460,995 discloses a foreign substance removing device for an image forming apparatus that removes a foreign substance layer adhering to a development gap maintaining member. The disclosed foreign substance removing device is configured to mount a blade for removing foreign substances, an elastic supporting member which elastically biases the blade, and a fixing frame for supporting the blade and the elastic supporting member inside the developing unit. However, the structure of this developing unit needs be improved, for example, by reducing its complexity to reduce manufacturing costs.

SUMMARY OF THE INVENTION

Therefore, it is an aspect of the general inventive concept to provide an image forming apparatus and a developing unit thereof that is improved so as to securely support sealing members to prevent a developer stored in the developing unit from leaking.

It is another aspect of the general inventive concept to provide an image forming apparatus and a developing unit thereof that is capable of cleaning the surface of contact members with a simple structure.

Additional aspects and utilities of the present general inventive concept will be set forth in part in the description which follows and, in part, will be obvious from the description, or may be learned by practice of the general inventive concept.

The foregoing and/or other aspects and utilities of the present inventive concept may be achieved by providing an image forming apparatus including a photosensitive member, a developer feeding member which feeds a developer to supply the developer to the photosensitive member, contact members which keep a development gap or a development nip between the photosensitive member and the developer feeding member, and a sealing member which contacts the developer feeding member to prevent leakage of the developer, the sealing member including cleaning portions which contact the contact members to clean a surface of the contact members.

The sealing member may further include a sealing portion for preventing leakage of the developer, and cut portions which section the sealing portion from the cleaning portions.

The contact members are disposed adjacent to both side ends of the developer feeding member, and a length in a longitudinal direction of the sealing member is larger than a sum of a length of the developer feeding member and lengths of the contact members.

The sealing member may further include a sealing portion which contacts the developer feeding member, and the sealing portion may have a length in a width direction different from each of the cleaning portions.

The image forming apparatus may further comprise a housing to which the developer feeding member is rotatably mounted. The sealing member may further include a fixed portion which is fixed to the housing below the developer feeding member.

The image forming apparatus may further comprise a clip which pressingly fixes the fixed portion to the housing.

The sealing member may include an elastic film member.

The foregoing and/or other aspects and utilities of the present inventive concept may also be achieved by providing a developing unit of an image forming apparatus which includes a housing having a development chamber and a developer feeding member mounted inside the housing and supplying a developer to a photosensitive member to develop an image, including a contact member which contacts the photosensitive member or the developer feeding member to keep a development gap or a development nip between the photosensitive member and the developer feeding member, and a film member which has a sealing portion contacting the developer feeding member to prevent leakage of the developer to an exterior of the development chamber and a cleaning portion contacting the contact member to remove foreign substances from the contact member.

The sealing portion and the cleaning portion may be disposed in alignment with each other along a longitudinal direction of the film member, and the film member may be provided with a cut portion which sections the sealing portion from the cleaning portion.

The film member may further include a fixed portion which is fixed to the housing below the developer feeding member. The sealing portion may extend from the fixed portion to the developer feeding member in a first direction, and the cleaning portion may extend from the fixed portion to the contact member in a second direction which makes a predetermined angle with the first direction.

The foregoing and/or other aspects and utilities of the present inventive concept may also be achieved by providing a developing unit usable with an image forming apparatus, including a photosensitive member, a developer feeding member which feeds a developer to supply the developer to the photosensitive member, one or more contact members to maintain one of a development gap and a development nip between the photosensitive member and the developer feeding member, and a sealing member to clean a surface of the contact members.

The contact members may be disposed one end portions of the developer feeding member, and the sealing member may be disposed to correspond to the contact members.

The sealing member may contact the developer feeding member to seal the developer.

The developing unit may further include a housing to contain the developer and to accommodate the developer feeding member, and the sealing member may be mounted on the housing.

The developing unit may further include a housing to contain the developer and to accommodate the developer feeding member, a restriction blade mounted on the housing to restrict the developer on the developer feeding member, and a first sealing member mounted on the restriction blade to seal the developer from the developer feeding member, and the sealing member may be disposed opposite to the restriction blade with respect to the developer feeding member as a second sealing member.

The developing unit may further include a supply roller to supply the developer to the developer feeding member, and the first sealing member may be disposed between the supply roller and the developer feeding roller.

The first sealing member may be detachably mounted on the restriction blade.

The developing unit may further include a supply roller to supply the developer to the developer feeding member, and the sealing member may include a first sealing member to seal the developer feeding member and the supply member, and a second sealing member having a cleaning portion to clean the surface of the contact members.

The second sealing member may include a sealing portion to seal a portion of the developer feeding member from the developer, and the cleaning portion and the sealing portion may be formed in a single monolithic body.

The second sealing member may include a sealing portion to seal a portion of the developer feeding member from the developer, and the first sealing member comprises a portion to overlap at least a portion of the sealing portion of the second seaming member.

The sealing member may include a fixed portion, a cleaning portion extended from the fixed portion toward the contact members to clean a surface of the contact members, and a sealing portion extended from the fixed portion toward a surface of the developer feeding member to seal the developer from a portion of the developer feeding member.

The sealing member may include a fixed portion, a cleaning portion extended from the fixed portion in a first direction to clean a surface of the contact members, and a sealing portion extended from the fixed portion in a second direction to seal the developer from a portion of the developer feeding member.

The developing unit may include a housing to contain the developer and to accommodate the developer feeding member, and the sealing member may include a fixed portion connected to the housing, a cleaning portion extended from a first portion of the fixed portion toward the contact members to clean a surface of the contact members, and a sealing portion extended from a second portion of the fixed portion toward a surface of the developer feeding member to seal the developer from a portion of the developer feeding member.

The first portion and second portion of the fixed portion may be disposed in a direction of a rotation axis of the developer feeding member.

The first portion may be disposed at opposite sides of the second portion to correspond to the contact members.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
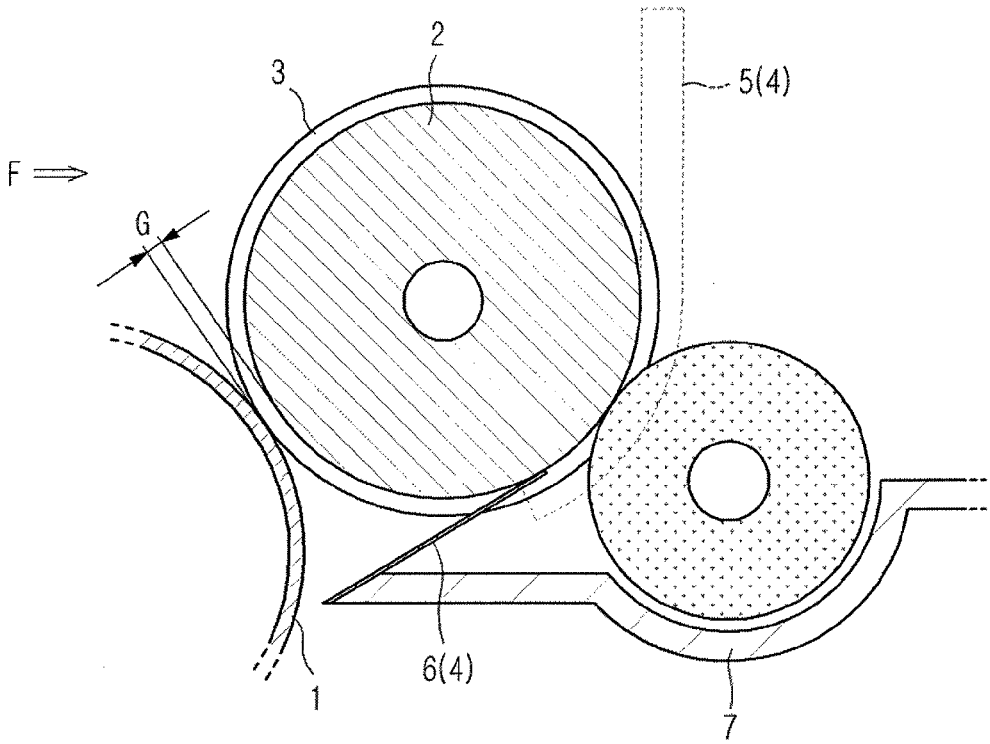
Fig. 1 (CONVENTIONAL ART)
FIG. 1 is a sectional view illustrating essential components of a conventional developing unit.
Figure 2:
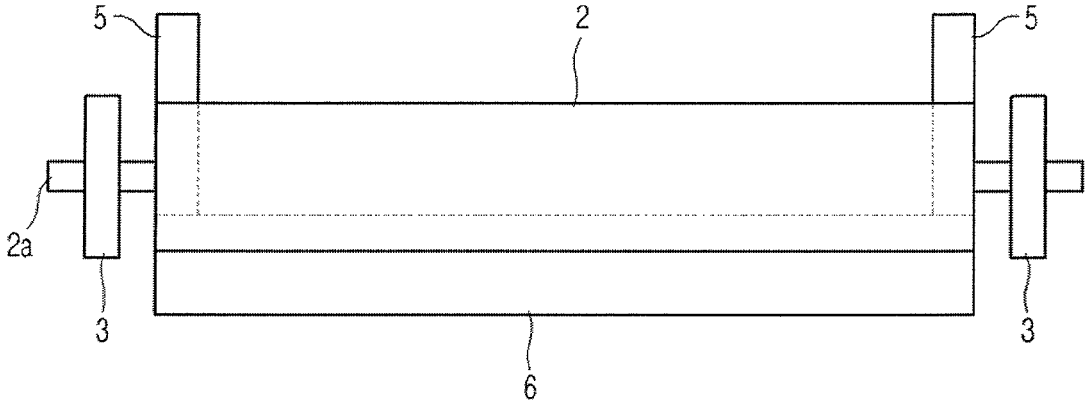
Fig. 2 (CONVENTIONAL ART)
FIG. 2 is a view seen in the F direction in FIG. 1.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

Figure 3:
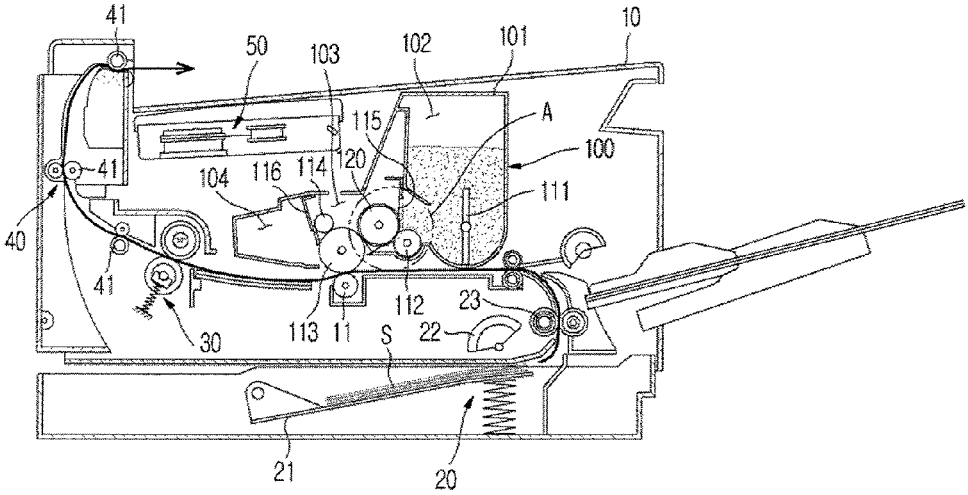
FIG. 3 is a side sectional view illustrating a constitution of an image forming apparatus.
Figure 4:
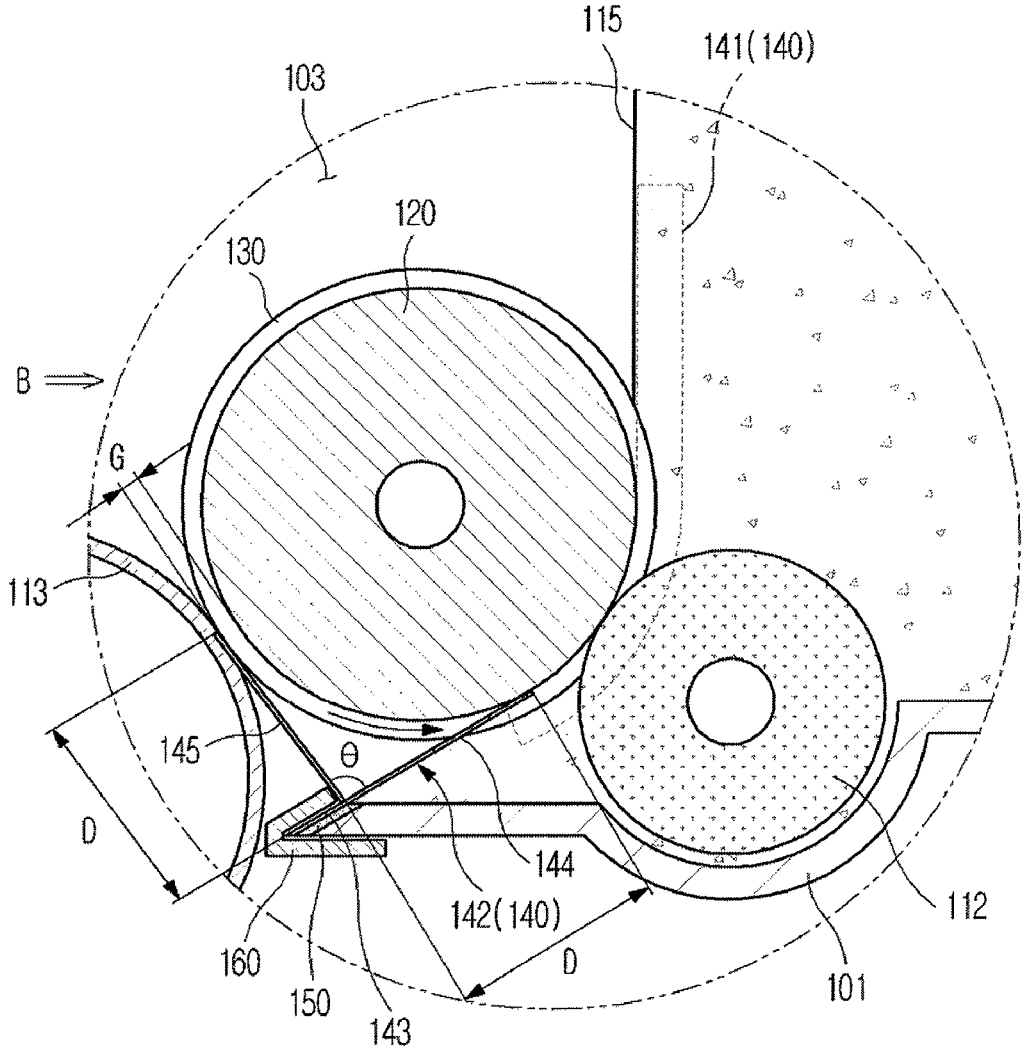
FIG. 4 is an enlarged view of a portion A of a developing unit in FIG. 3.

FIG. 3 is a side sectional view illustrating the constitution of an exemplary image forming apparatus, and FIG. 4 is an enlarged view of an A portion in FIG. 3.

As illustrated in FIG. 3, the exemplary image forming apparatus includes a main body 10 which forms an exterior appearance and supports components mounted therein, a paper feeding unit 20 which supplies paper S to be printed, a developing unit 100 which develops an image on the paper, a fixing unit 30 which fixes the developed image onto the paper by applying heat and pressure to the papers, and a paper discharge unit 40 which discharges the printed paper outside. As noted, the printing medium of this example is paper S, but the image forming apparatus may use other types of printing mediums besides paper as desired.

The paper feeding unit 20 includes a paper tray 21 on which the paper S is loaded, a pickup roller 22 which picks up the paper S loaded on the paper tray 21 sheet by sheet, and a feed roller 23 which feeds the picked-up paper toward the developing unit 100.

As illustrated in FIGS. 3 and 4, the developing unit 100 includes a housing 101 which forms an exterior appearance and supports components mounted inside the developing unit 100. The housing 101 has a developer storage chamber 102 in which the developer is stored, and a development chamber 103 in which the developing process is performed through the developer supplied from the developer storage chamber 102.

The developer storage chamber 102 accommodates an agitating blade 111 which agitates the developer stored in the developer storage chamber 102 so that the developer does not solidify, and a supply roller 112 which supplies the developer from the developer storage chamber 102 to the development chamber 103. The supply roller 112 rotates while contacting a developer feeding member 120 (which will be described later) to supply the developer to the developer feeding member 120.

The development chamber 103 accommodates a photosensitive member 113 on which an electrostatic latent image is formed by an exposure device 50 according to image information, a charge roller 114 to charge the surface of the photosensitive member 113 with a predetermined electric potential, and the developer feeding member 120 which feeds the developer supplied by the supply roller 112 to the photosensitive member 113 to develop the electrostatic latent image formed on the photosensitive member 113 to a visible image. The developer feeding member 120 is rotatably supported by both inner-side surfaces of the housing 101 by means of a rotating shaft 120*a* (refer to FIG. 5).

The housing 101 further accommodates a restriction blade 115 and a cleaning blade 116. The restriction blade 115 restricts the thickness of the developer adhering to the surface of the developer feeding member 120 by the supply roller 112. The cleaning blade 116 removes the developer which is not transferred to the paper and remains on the surface of the photosensitive member 113. The waste developer removed by the cleaning blade 116 is collected in a waste developer storage chamber 104 inside the housing 101.

Figure 5:
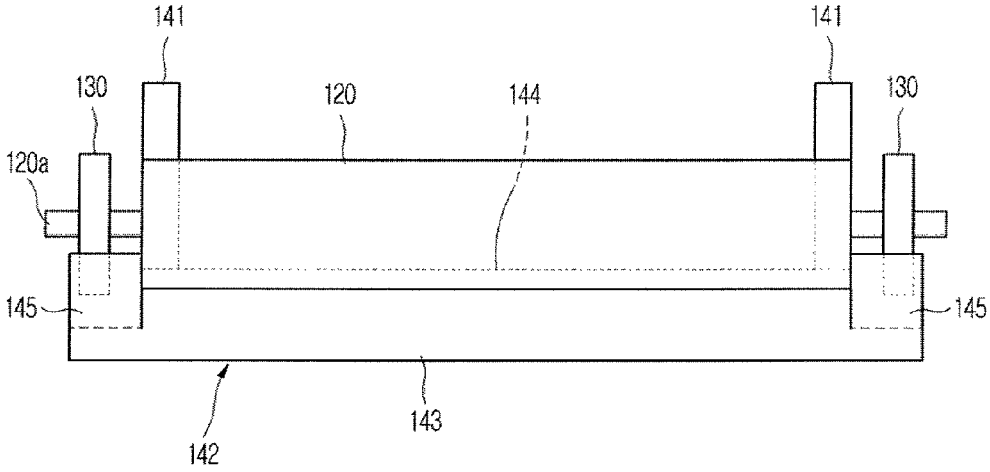
FIG. 5 is a view illustrating a developer feeding member, a contact member and a sealing member, seen in a B direction in FIG. 4.
Figure 6:
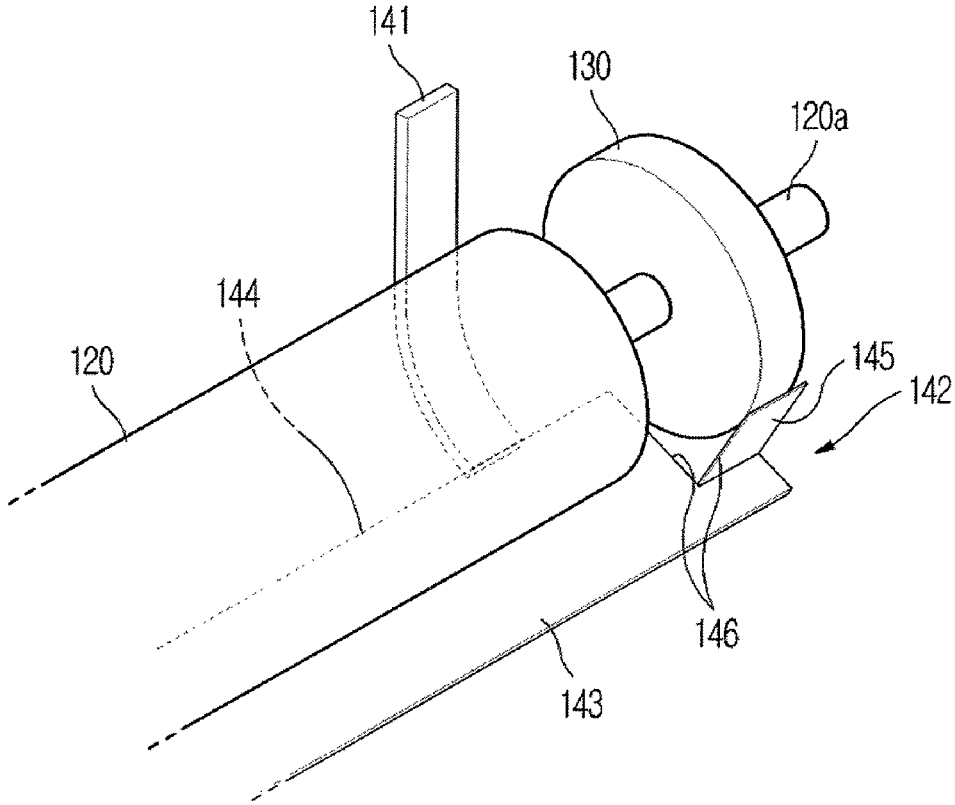
FIG. 6 is a perspective view illustrating one side portion of the developer feeding member of FIG. 5.

FIG. 5 is a view illustrating the developer feeding member 120 having contact members 130 and a sealing member 140, seen in the B direction in FIG. 4, and FIG. 6 is a perspective view illustrating one side portion of the developer feeding member 120 depicted in FIG. 5.

As illustrated in FIGS. 4 to 6, the contact members 130 are rotatably coupled to the rotating shaft 120*a* of the developer feeding member 120. The outer peripheral surface of each of the contact members 130 is in contact with the photosensitive member 113. When the photosensitive member 113 rotates, the contact members 130 rotate together with the photosensitive member 113. The contact members 130 are disposed at both end portions of the rotating shaft 120*a*, with the developer feeding member 120 interposed therebetween.

Each of the contact members 130 has an outer diameter larger than the developer feeding member 120, so that the contact members 130 keep a constant development gap G between the developer feeding member 120 and the photosensitive member 113. The developing gap G is formed between the contact members 130. Alternatively, if the developing unit is configured such that the developer is supplied to the photosensitive member through the constant gap G while the developer feeding member directly contacts the photosensitive member, the contact members keep a constant development nip between the developer feeding member and the photosensitive member.

Also, the developing unit 100 includes the sealing device 140 which prevents the developer in the development chamber 103 from leaking outside of the housing 101. The sealing device 140 includes first sealing members 141 which prevent the developer from leaking through both side portions of the developer feeding member 120, and a second sealing member 142 which prevents the developer from leaking through a lower portion of the developer feeding member 120. The first sealing members 141 are disposed such that they contact the outer peripheral surface of both axial end portions of the developer feeding member 120.

The first sealing members 141 are made of a material that is biased to closely contact the developer feeding member 120 by their own elasticity. For example, the first sealing members 141 may be made of compressed felt combined with Teflon or a sponge. The second sealing member 142 may be formed with a film member having a constant elasticity.

The second sealing member 142 has a fixed portion 143 which is fixed to the housing 101. The fixed portion 143 may be fixed to the housing 101 by means of a bonding member 150 such as a double-sided adhesive tape. So as to more securely fix the second sealing member 142 to the housing 101, as illustrated in FIG. 4, a clip 160 may be additionally used. A first piece of the clip 160 supportedly contacts the housing 101, and a second piece of the clip 160 elastically biases the fixed portion 143 of the second sealing member 142 toward the housing 101. Accordingly, even if the adhesive force of the bonding member 150 is weakened, the clip 160 prevents the separation of the second sealing member 142 from the housing 101.

The second sealing member 142 is positioned below the developer feeding member 120, and extends along the axial direction of the developer feeding member 120 to where the contact members 130 are mounted. In other words, the longitudinal length of the second sealing member 142 is larger than the longitudinal length of the developer feeding member 120 and extends out to or past the outside portions of the contact members 130. The longitudinal length of the second sealing member 142 may be larger than the sum of the longitudinal length of the developer feeding member 120 and the longitudinal lengths of the contact members 130. Although the first sealing members 141 interfere with the second sealing member 142 when the developer feeding member 120 rotates, by extending the second sealing member 142 out to the contact members 130, the effects of the interference of the first sealing members 141 on both ends of the second sealing member 142 (where the effect of the adhesive is weakest) is reduced as the ends of the second sealing member may be located further away from the first sealing members, as compared to the conventional art described above. Further, the interference is reduced by the addition of the bonding member 150.

The second sealing member 142 includes a sealing portion 144 which extends from the fixed portion 143 toward the developer feeding member 120 such that one end contacts the outer peripheral surface of the developer feeding member 120, and cleaning portions 145 which extend from the fixed portion 143 toward the contact members 130 such that one end of each of the cleaning portions 145 contacts the outer peripheral surface of each of the contact members 130. The sealing portion 144 seals a space between the bottom of the developer feeding member 120 and the housing 101 to prevent the developer in the development chamber 103 from leaking to the exterior of the housing 101. The cleaning portions 145 scrape out foreign substances adhering to the surface of the contact members 130 when the contact members 130 rotate. Because the contact members 130 in this example can be cleaned using the sealing member which prevents leakage of the developer, a separate device for cleaning the contact members 130 is not needed and thus the inner structure of the developing unit is simplified.

The sealing portion 144 and the cleaning portions 145 of the second sealing member 142 are sectioned in left and right directions by cut portions 146 which are formed by cutting a portion of the second sealing member 142 in a width direction (here, perpendicular to the axis of the developer feeding member). After forming the cut portions 146 of the second sealing member 142, the cleaning portions 145 positioned exterior to the sealing portion 144 are folded at a proper angle so that the cleaning portions 145 extend to a position capable of effectively cleaning the surface of the contact members 130. As illustrated in FIGS. 4 and 6, in this example the sealing portion 144 extends out to the bottom surface of the developer feeding member 120 and the cleaning portions 145 extend upwards to the surface of the contact members 130 at an angle $\Theta$ with respect to the extending direction of the sealing portion 144. The sealing portion 144 and the cleaning portion 145 are disposed opposite to each other with respect to the fixed portion 143.

Also, as illustrated in FIG. 4, in this example the length D of the sealing portion 144 (i.e., the size of the sealing portion 144 extending from the fixed portion 143 to a distal end of the sealing portion 144) is equal to that of each of the cleaning portions 145 (i.e., the length D of the cleaning portions 145 extending from the fixed portion 143 to a distal end of cleaning portion 145). However, the sealing portion 144 and the cleaning portions 145 may have different lengths as desired. Such a modified embodiment will be described with reference to FIG. 7. The first sealing member 141 may have a first thickness, and at least one of the sealing portion 144 and the cleaning portion 145 may have a second thickness. The first thickness may be thicker than the second thickness.

Figure 7:
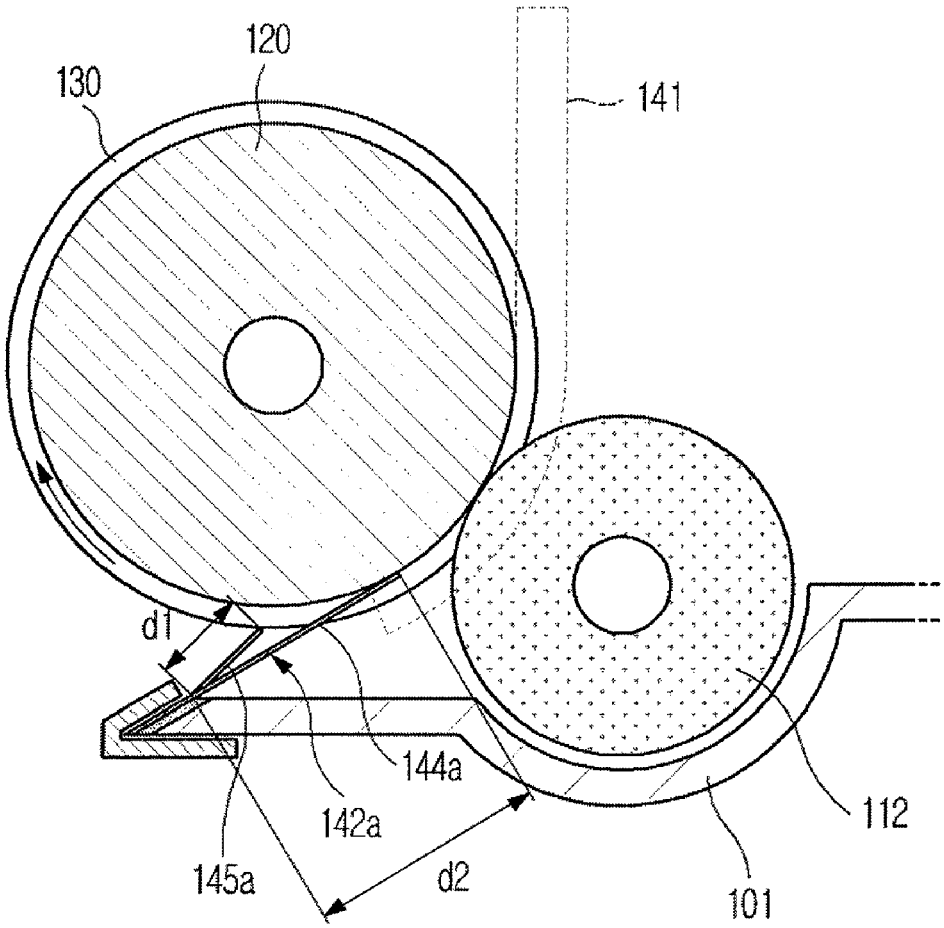
FIG. 7 is a sectional view illustrating a modification of a second sealing member in a sealing member of a developing unit.

FIG. 7 is a sectional view illustrating an example modification of the second sealing member. When compared to the previous embodiment illustrated in FIG. 4, this embodiment has a structural difference in the position where the cleaning portions of the second sealing member contact the contact members. The following description will highlight the differences between the embodiments, and the same elements as the previous embodiment illustrated in FIG. 4 are denoted by the same reference numerals.

As illustrated in FIG. 7, the cleaning portions 145*a* of the second sealing member 142*a* extend rearward to the contact members 130. While the previous embodiment illustrated in FIG. 4 has a structure that the cleaning portions 145 extend forward to contact the front surface of the contact members 130, this embodiment of FIG. 7 has a structure that the cleaning portions 145*a* extend rearward to contact the bottom surface of the contact members 130. The reason for the difference in the extending directions of the cleaning portions 145 and 145*a* in two embodiments is that the contact position of the cleaning portions capable of effectively achieving the cleaning performance is changed according to the rotational direction of the contact members 130.

The rotational direction of the contact members 130 may be set differently according to the design. When the contact members 130 are set to rotate in the counterclockwise direction, as illustrated in FIG. 4, the cleaning portions 145 preferably should extend forward to contact the front surface of the contact members 130 so as to more effectively scrape out foreign substances adhering to the contact members 130. On the other hand, when the contact members 130 are set to rotate in the clockwise direction, as illustrated in FIG. 7, the cleaning portions 145*a* preferably should extend rearward to contact the bottom surface of the contact members 130 so as to more effectively scrape out foreign substances adhering to the contact members 130. in other words, it is preferable that the edge of the cleaning portions (145*a* or 145) are positioned to exert a pushing force onto the contact members 130 rather than a pulling force in order to more effectively scrape out foreign substances.

In this embodiment, the length d1 of each of the cleaning portions 145*a* is shorter than the length d2 of the sealing portion 144*a*. This may be helpful when the cleaning portions 145*a* extend rearward to contact the bottom surface of the contact members 130.

Hereinafter, an example of the operation of the image forming apparatus will be described with reference to FIGS. 3 and 4. If a print command is inputted, the paper S loaded on the paper tray 21 is picked up by the pickup roller 22 and fed along a transfer path. An electrostatic latent image is formed on the surface of the photosensitive member 113, which is charged by the charge roller 114, by the exposure device 50. The developer stored in the developer storage chamber 102 is supplied to the developer feeding member 120 by the supply roller 112. The developer feeding member 120 feeds the developer to the development gap G formed between the photosensitive member 113 and the developer feeding member 120. Developer fed to the development gap G moves to the photosensitive member 113 by a potential difference between the electrostatic latent image on the photosensitive member 113 and the surface of the developer feeding member 120 to develop the electrostatic latent image on the photosensitive member 113 to a visible image.

At this time, the contact members 130 rotate while contacting the photosensitive member 113 to keep the development gap G constant. Because the sealing members 141 and 142 cannot perfectly prevent the developer from leaking, due to exterior shock or scattering of the developer in the development process for example, the surface of the contact members 130 may be contaminated with the developer. To address this problem, the cleaning portions 145 of the second sealing member 142 contacting the contact members 130 scrape off foreign substances from the contact members 130 when the contact members 130 rotate, thereby keeping the surface of the contact members 130 clean without a separate cleaning device.

Also, the image forming apparatus further includes a transfer roller 11 which is mounted inside the main body 10 while opposing the photosensitive member 113. When the paper passes between the photosensitive member 113 and the transfer roller 11, the visible image on the photosensitive member 113 is transferred onto the paper. While passing through the fixing unit 30, the visible image transferred onto the paper is fixed to the paper. The paper having passed through the fixing unit 30 is discharged outside of the main body 10 by discharge rollers 41.

In the above embodiments, the contact members are mounted to the rotating shaft of the developer feeding member, however the second sealing member is also applicable to a structure where the contact members are mounted to the photosensitive member. If the contact members are mounted to the photosensitive member, the contact members maintain the development gap or the development nip by contacting the developer feeding member.

As apparent from the above description, the image forming apparatus according to the above embodiments is capable of cleaning the contact members by using the developer leakage preventing components without a separate cleaning device. Accordingly, the inner structure of the developing unit may be simplified, and manufacturing costs may be reduced due to the decreased number of components.

Also, even if the first sealing members interfere with the second sealing member, since the interference with the portions of the second sealing member having the weakest adhesive force is reduced, the second sealing member is not easily separated from the housing of the developing unit.

Although a few embodiments of the present general inventive concept have been shown and described, it would be appreciated by those skilled in the art that changes may be made in this embodiment without departing from the principles and spirit of the general inventive concept, the scope of which is defined in the claims and their equivalents. As used in this disclosure, the term "preferably" is non-exclusive and means "preferably, but not limited to." Terms in the claims should be given their broadest interpretation consistent with the general inventive concept as set forth in this description. For example, the terms "coupled" and "connect" (and derivations thereof) are used to connote both direct and indirect connections/couplings. As another example, "having" and "including", derivatives thereof and similar transition terms or phrases are used synonymously with "comprising" (i.e., all are considered "open ended" terms)—only the phrases "consisting of" and "consisting essentially of" should be considered as "close ended". Claims are not intended to be interpreted under 112 sixth paragraph unless the phrase "means for" and an associated function appear in a claim and the claim fails to recite sufficient structure to perform such function.

What is claimed is:

1. An image forming apparatus comprising:

a first roller;

a second roller arranged adjacent to the first roller;

space-maintaining members arranged on the second roller and having diameters larger than a diameter of the second roller to maintain a spacing between the first roller and the second roller; and a regulating member including cleaning portions to clean surfaces of the space-maintaining members and a sealing portion to prevent a developer from leaking around the second roller, wherein the cleaning portions are bent from the sealing portion to form a predetermined angle with respect to the sealing member such that the cleaning portions extend toward the surfaces of the space-maintaining members, respectively.

2. The image forming apparatus of claim 1, wherein:

the first roller includes a photosensitive member; and the second roller includes a developer feeding member which feeds the developer to supply the developer to the photosensitive member.

3. The image forming apparatus of claim 1, wherein the regulating member further includes cut portions which section the sealing portion from the cleaning portions.

4. The image forming apparatus of claim 1, wherein the space-maintaining members are disposed adjacent to both side ends of the second roller, and a length in a longitudinal direction of the regulating member is larger than a sum of a length of the second roller and lengths of the space-maintaining members.

5. The image forming apparatus of claim 1, wherein the sealing portion has a length in a width direction different from each of the cleaning portions.

6. The image forming apparatus of claim 1, wherein an extension length of the sealing portion from a point where the regulating member is connected to a developer housing to an edge of the sealing portion contacting the second roller is different from an extension length of the cleaning portions from a point where the cleaning portions are connected to the developer housing to an edge of the cleaning portions contacting the space-maintaining members.

7. The image forming apparatus of claim 1, further comprising:

a housing to which the second roller is rotatably mounted, wherein the regulating member further includes a fixed portion which is fixed to the housing.

8. The image forming apparatus of claim 7, further comprising:

a clip which presses the fixed portion to the housing.

9. The image forming apparatus of claim 1, wherein the regulating member includes an elastic member.

10. A developing unit usable with an image forming apparatus comprising:

a housing having a development chamber;

a photosensitive member mounted to the housing;

a developer feeding member mounted to the housing to supply a developer to the photosensitive member to develop an image;

a contact member which contacts one of the photosensitive member and the developer feeding member to keep one of a development gap and a development nip between the photosensitive member and the developer feeding member; and a film member which has a sealing portion contacting the developer feeding member to seal the developer inside the development chamber and a cleaning portion to contact the contact member to remove foreign substances from the contact member, wherein the cleaning portion is bent from the sealing portion such that the cleaning portions forms a predetermined angle with respect to the sealing portion.

11. The developing unit of claim 10, wherein:

the sealing portion and the cleaning portion are aligned along a longitudinal direction of the film member; and the film member is provided with a cut portion which separates the sealing portion from the cleaning portion.

12. The developing unit of claim 10, wherein the film member further includes a fixed portion which is fixed to the housing, and the sealing portion extends from the fixed portion to the developer feeding member in a first direction, and the cleaning portion extends from the fixed portion to the contact member in a second direction which forms an angle greater than zero with respect to the first direction.

13. The developing unit of claim 10, wherein the sealing portion has a length in a width direction different from the cleaning portion.

14. A developing unit usable with an image forming apparatus, comprising:

a photosensitive member;

a developer feeding member which feeds a developer to supply the developer to the photosensitive member;

one or more contact members to maintain a position of the photosensitive member with respect to the developer feeding member; and a sealing member to contact a surface of the contact members to clean the surface of the contact members, wherein the sealing member comprises a fixed portion, a cleaning portion extended from the fixed portion in a first direction to clean the surface of the contact members, and a sealing portion extended from the fixed portion in a second direction to seal the developer from a portion of the developer feeding member.

15. The developing unit of claim 14, wherein the contact members are disposed one end portions of the developer feeding member, and the sealing member is disposed to correspond to the contact members.

16. The developing unit of claim 14, wherein the sealing member contacts the developer feeding member to seal the developer, and contacts the contact members to clean the surface of the contact member.

17. The developing unit of claim 14, further comprising:

a housing to contain the developer and to accommodate the developer feeding member, wherein the sealing member is mounted on the housing.

18. The developing unit of claim 14, further comprising:

a housing to contain the developer and to accommodate the developer feeding member;

wherein the fixed portion of the sealing member is connected to the housing, the cleaning portion extends from a first portion of the fixed portion toward the contact members to clean the surface of the contact members, and the sealing portion extends from a second portion of the fixed portion toward the surface of the developer feeding member.

19. The developing unit of claim 18, wherein the first portion and second portion of the fixed portion are disposed in a direction of a rotation axis of the developer feeding member.

20. The developing unit of claim 18, wherein the first portion is disposed at opposite sides of the second portion to correspond to the contact members.

* * * * *